US006167788B1

(12) United States Patent
Schönberger et al.

(10) Patent No.: US 6,167,788 B1
(45) Date of Patent: Jan. 2, 2001

(54) TORQUE WRENCH

(75) Inventors: Heinz Schönberger; Frank Humme, both of Solingen (DE)

(73) Assignee: Saltus-Werk Max Forst GmbH, Solingen (DE)

( * ) Notice: Under 35 U.S.C. 154(b), the term of this patent shall be extended for 0 days.

(21) Appl. No.: 09/254,051

(22) PCT Filed: Jul. 11, 1997

(86) PCT No.: PCT/EP97/03696

§ 371 Date: Feb. 26, 1999

§ 102(e) Date: Feb. 26, 1999

(87) PCT Pub. No.: WO98/10901

PCT Pub. Date: Mar. 19, 1998

(30) Foreign Application Priority Data

Sep. 12, 1996 (DE) ..... 196 37 067

(51) Int. Cl.[7] ..... B25B 23/14
(52) U.S. Cl. ..... 81/467; 81/429; 73/862.23
(58) Field of Search ..... 81/467, 429; 73/862.23, 73/141, 139, 862.26

(56) References Cited

U.S. PATENT DOCUMENTS

| | | | | |
|---|---|---|---|---|
| 3,970,155 | * | 7/1976 | Otto | 73/139 |
| 4,006,629 | * | 2/1977 | Barrett et al. | 73/139 |
| 4,176,436 | | 12/1979 | McCombs et al. . | |
| 4,265,109 | * | 5/1981 | Hallbauer et al. | 73/862.23 |
| 5,172,616 | * | 12/1992 | Negishi | 81/467 |
| 5,303,601 | * | 4/1994 | Schonberger et al. | 73/862.23 |
| 5,476,014 | * | 12/1995 | Lampe et al. | 73/862.23 |
| 5,589,644 | * | 12/1996 | Becker et al. | 73/862.23 |

FOREIGN PATENT DOCUMENTS

| | | | |
|---|---|---|---|
| 3128557 | | 3/1983 | (DE) . |
| 34 29 950 A1 | * | 2/1986 | (DE) . |
| 4243317 | | 6/1993 | (DE) . |
| 4343110 | | 6/1994 | (DE) . |
| 196 37 540 A1 | * | 3/1998 | (DE) . |
| 0133557 | | 2/1985 | (EP) . |
| 0490376 | | 6/1992 | (EP) . |

* cited by examiner

*Primary Examiner*—Stephen F. Gerrity
*Assistant Examiner*—Hadi Shakeri
(74) *Attorney, Agent, or Firm*—Martin A. Farber

(57) ABSTRACT

A torque wrench is provided with an electronic evaluation device for obtaining values measured by sensors in order to detect the torque and an angle of rotation. An acceleration sensor detects the acceleration of the angle of rotation ($\alpha$) whose measured values are chronologically integrated twice by an evaluation device in order to determine the angle of rotation ($\alpha$). The angle determination begins upon the reaching of a starting value of torque.

14 Claims, 4 Drawing Sheets

On
15
Self-test
Calibration
16
Setting the
parameters
Start
17
Torque
measurement M
18
19
Acceleration
measurement $\ddot{\alpha}$
20
$M \geq M_s$
No
Yes
21
$\dot{\alpha} > 0$
No
Yes
22
$\Delta\alpha = \iint \ddot{\alpha} dt$
$\alpha = \alpha + \Delta\alpha$
23
Set
$\beta = \alpha = 0$ 18
Torque measurement
M
Acceleration measurement
19
30
$M_{min} \leq M \leq M_{max}$
$\beta_{min} \leq \beta \leq \beta_{max}$
No
31
$M \geq M_{max}$
$\beta \geq \beta_{max}$
No
Yes
Yes
32
Signal triggering
'O.K.'
35
Signal triggering
'faulty'
33
$M = 0$
$\dot{\alpha} = 0$
$\ddot{\alpha} = 0$
No
36
$M = 0$
$\dot{\alpha} = 0$
$\ddot{\alpha} = 0$
No
Yes
Yes
34
Final value
indication
'O.K.'
37
Final value
indication
'faulty'

TORQUE WRENCH

FIELD AND BACKGROUND OF THE INVENTION

The invention relates to a torque wrench having an electronic evaluation device for measurement values from sensors for detecting the torque and a rotary angle.

Such a torque wrench is known from EP 0,133,557. In the torque wrench there, a microprocessor is provided, which has a keyboard by way of which data required in each particular case, such as desired values, limit values or the like, selected as presettings, can be entered for the purpose of the tightening operation. The tightening operation, for example the tightening of a screw, is monitored according to these presettings. In this case, when specific limit values are reached, these values which are reached are stored automatically. It became clear that one disadvantage there was the transmission technology for the measurement values of the rotary-angle measuring arrangement, which consists substantially of a pulse wheel and a reflex probe. This transmission technology is very costly and, for example, is highly susceptible to contamination. Furthermore, the geometry of the wrench is substantially determined by the pulse-wheel/reflex-probe arrangement.

SUMMARY OF THE INVENTION

There is, therefore, the technical problem of improving, which is an object of the present invention, the transmission technology for detecting the rotary angle, and to improve the torque wrench.

According to the invention the evaluation device (5) is programable with a starting torque ($M_s$) and determines a deflection angle ($\beta$) when the starting torque ($M_s$) is reached. The type of time integration depends on the overall design of the evaluation device and, in particular, also on the output of measurement values from the acceleration sensor. Thus, integration may take place in a way known per se by means of differential amplifiers, if the evaluation of the measurement values is carried out by analog means. If, for example, a microprocessor is provided, evaluation may also be carried out digitally and, for this purpose, there are various numerical integration methods available, by means of which the microprocessor can then be programmed. Suitable acceleration sensors are known and are commercially available. Preferably, those acceleration sensors are used which are disposed at a specific distance from the pivot axis in the torque wrench and for which the pivot axis in the torque wrench serves as a virtual fixed point. This distance depends on the type of acceleration sensor used and must also be adjusted accordingly. In contrast to acceleration sensors for detecting rotary-angle accelerations which are arranged, for example, annularly about an axis of rotation, the preferred arrangement has the advantage that, here, no measurement takes place between components fixed relative to the axis of rotation and components fixed relative to the wrench. A deflection angle is to be understood below as referring to that fraction of the rotary angle which normally begins to be measured from specific initial conditions of a zero angle position, such as, for example, a spatial position of the torque wrench relative to a housing, and likewise then ends with the termination of the tightening operation or monitoring operation. As a result, in addition to the measurement of the torque, the secure tightening of, for example, a screw is also detected by means of the deflection angle. Such a zero angle position may, for example, be entered manually in the torque wrench. Usually, however, a torque wrench of the type mentioned in the introduction is used for monitoring the tightening of, for example, screws for a multiplicity of identical screw connections during mass production. In this case, it proved expedient for the evaluation device to be preprogrammable with a starting torque and for a deflection angle to be determined from the moment when the starting torque is reached. As a result, initially, the detection of the torque is linked to the detection of the rotary angle in order to determine the deflection angle. The consequence of this is that the beginning of the determination of the deflection angle is, as it were, automated. According to the invention, the acceleration sensor detects a rotary-angle acceleration which may be both positive and negative in the tightening direction of, for example, a screw, the screw nevertheless being tightened with a positive torque. If, however, the torque or the angular speed becomes negative when a ratchet or lever brace is used, specifically during the return of the torque wrench opposite to the tightening direction, this angular range covered by the torque wrench should not be taken into account, since it does not contribute to the tightening of the screw. It is therefore expedient for the measurement values from the acceleration sensor to be evaluated only in a predeterminable direction of rotation. In a further embodiment, there is provision for the evaluation device to be preprogrammable in each case with a lower and an upper limit value for the torque and with a deflection angle and for the evaluation device to indicate actual values lying between the respective limit values. This results in double monitoring of the tightening operation as to whether a predetermined range both of the torque and of the deflection angle has been reached. Furthermore, there may also be provision for the evaluation device to indicate that the lower limit value of the torque and/or of the deflection angle has already been exceeded. The user is thereby advised that the operation of tightening, for example, a screw is approaching the end and he must then also monitor the upper limit values to ensure that these are not exceeded. The exceeding of the upper limit value of the torque and/or of the deflection angle is likewise indicated by the evaluation device, thereby signalling that this tightening operation has not been properly concluded. It proved expedient to effect such an indication that limit values are reached or exceeded by means of at least one light-emitting diode. In this case, there is a multiplicity of indicating possibilities, for example the exceeding of the limit values of the torque or of the deflection angle may be signalled by a colour change or flashing. Final values reached are jointly indicated in a conventional way on an LCD display or a change-over of the measuring mode may also take place and a reversible alternative indication of the final torque and/or of the final deflection angle may be effected. These final values may be stored by the microprocessor, transmitted to a computer by means of a corresponding interface or output directly to a printer.

BRIEF DESCRIPTION OF THE DRAWINGS

With the above and other objects and other advantages in view, the present invention will become more clearly understood in connection with the detailed description of a preferred embodiment, when considered with the accompanying drawings of which

DETAILED DESCRIPTION OF THE PREFERRED EMBODIMENT

Figure 1:
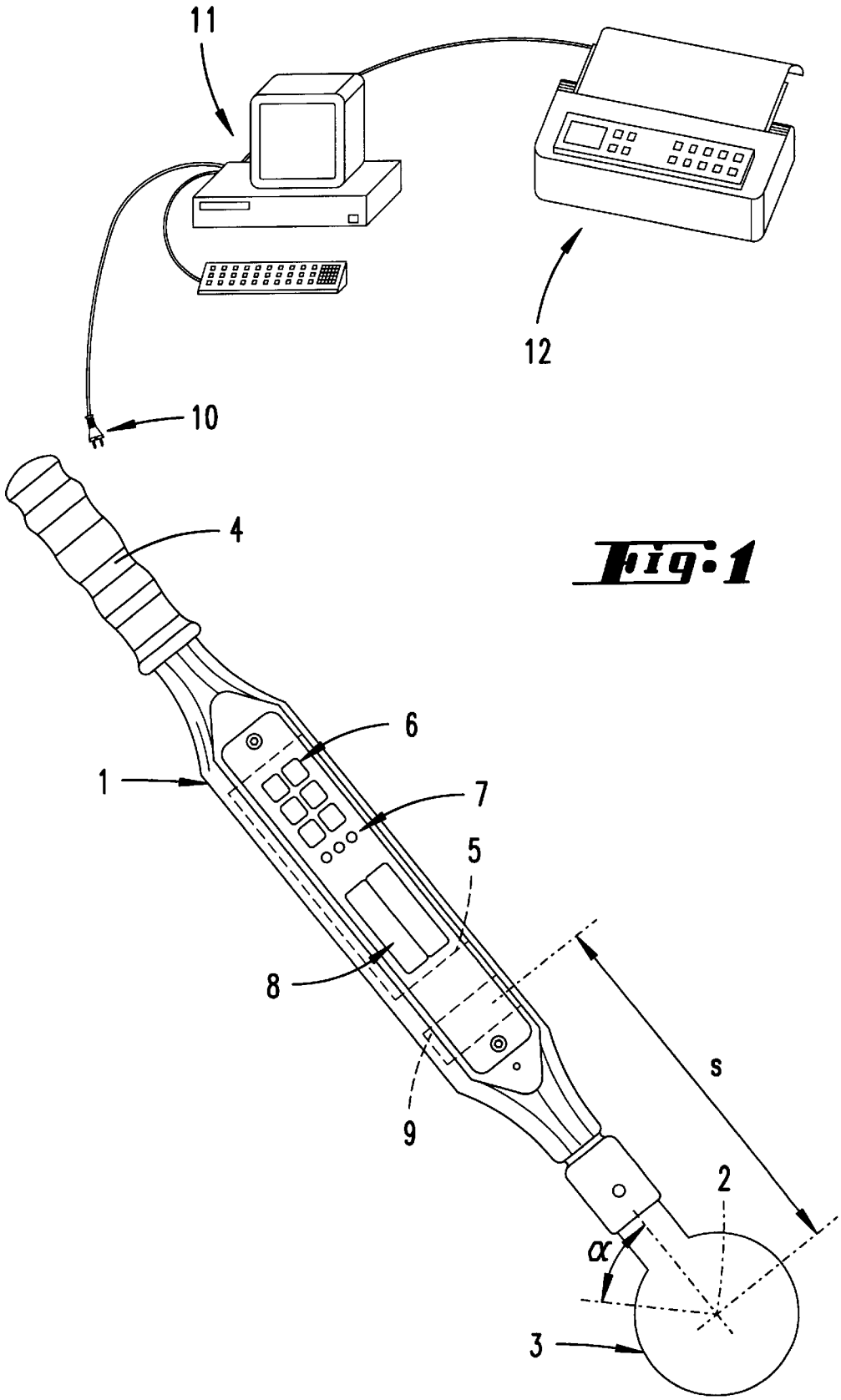
FIG. 1 shows an illustration of the torque wrench according to the invention and of its essential components.

FIG. 1 shows the essential components of a torque wrench 1 according to the invention. In order to tighten a screw, a nut or the like about an axis of rotation 2, the said torque wrench has an insertable tool 3 which is held on the torque wrench 1 by means of a conventional socket.

Held by means of a handle 4, the torque wrench 1 is guided about the axis of rotation 2 over an angular range $\alpha$. Here, in respect of the tightening of, for example, a screw, a rotary angle $\alpha$ measured clockwise and a torque applied in this direction are regarded as positive. It goes without saying that the direction of measurement can be reversed, for example for screws having a left-hand thread. The angular speed $\dot{\alpha}$ and the angular acceleration $\alpha$ are also correspondingly regarded as positive in the clockwise direction.

The torque wrench 1 has an electronic evaluation device 5 for the evaluation of measurement values provided by sensors for detecting or calculating the torque M and the rotary angle $\alpha$. A keypad 6 serves for the programming of, for example, a microprocessor of the evaluation device and, in particular, for entering limit values relating to the rotary angle or deflection angle $\beta$ and to the torque M. The reaching or exceeding of such limit values is indicated by an LED row 7. Final values of the torque M and of the rotary angle or deflection angle $\alpha$, $\beta$ are reproduced on an LCD display 8.

Measurement and evaluation of the torque M is carried out according to known methods.

In the torque wrench 1 according to the invention, in order to detect the rotary angle a and determine the deflection angle $\beta$, an acceleration sensor 9 for detecting the rotary-angle acceleration $\dot{\alpha}$ is provided, the said sensor being disposed within the torque wrench 1 at a specific distance s from the axis of rotation 2. The pivot axis 2 serves, for the acceleration sensor 9, as a virtual fixed point, about which it is then also pivoted. This distance s is substantially determined by the design of the acceleration sensor 9 used, which is commercially available.

By way of a plug connection 10, the torque wrench 1 can be connected, via a conventional interface, for example, to a computer 11 and/or to a printer 12 for logging the measurements.

Figure 2:
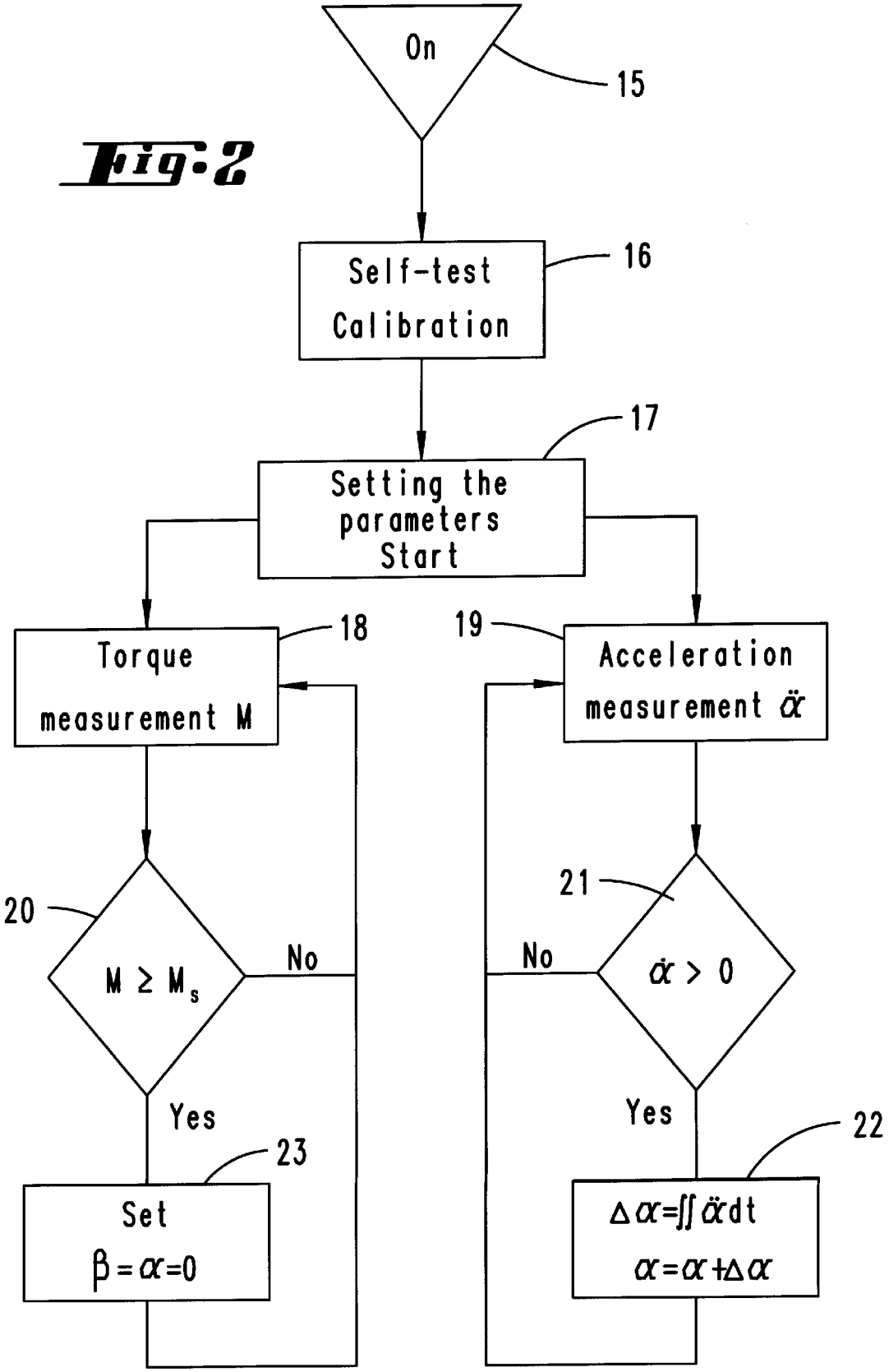
FIG. 2 shows a flow diagram, by means of which the first phase of a tightening operation after the torque wrench has been switched on is explained.
Figure 3:
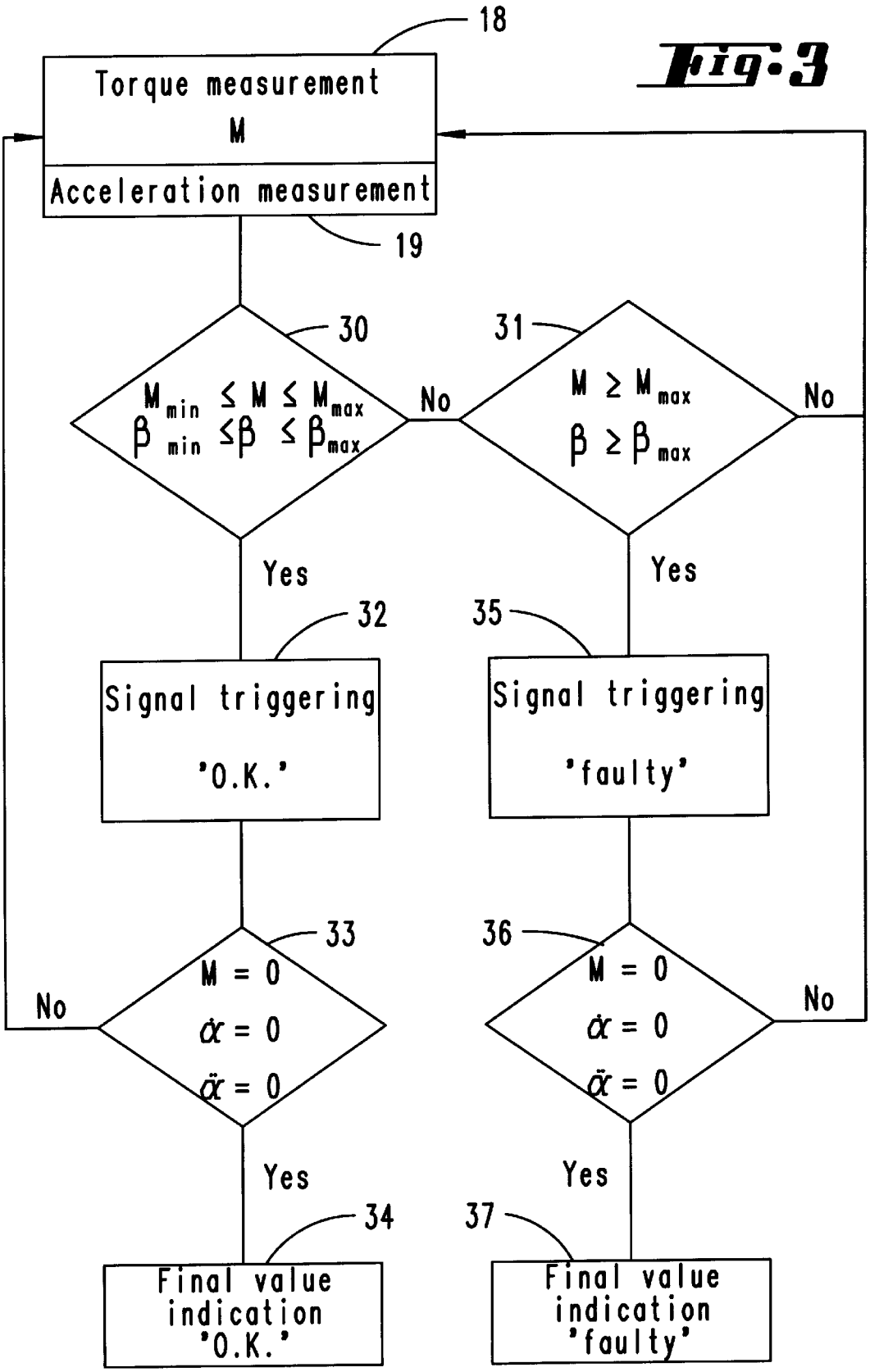
FIG. 3 shows a flow diagram for determining the deflection angle.

The evaluation of the measurement values by the evaluation device 5 is explained in more detail below with reference to the flow diagrams according to FIGS. 2 and 3. After the switching-on step 15, in step 16, a self-test and zero-balancing are carried out automatically by the evaluation device 5. After this, if appropriate, calibration of the torque wrench 1 is to be provided. In addition to the known calibration of the torque-measuring device, separate calibration is to be carried out, here, for the rotary-angle measurement. This may be carried out, for example, by applying the torque wrench 1 and setting the memory for the rotary angle manually to the value zero. The torque wrench 1 is subsequently pivoted about its axis of rotation 2 over a specific angular range which must then also be indicated by the evaluation device.

After step 16, which, if appropriate, may even be skipped, the setting of the parameters for the measuring operation takes place in step 17. Irrespective of the sequence, the first of these is the starting torque $M_s$. The starting torque M may, of course, also be set equal to zero, the rotary angle $\alpha$ and deflection angle $\beta$ then coinciding. Here, however, a starting torque $M_s$ greater than zero is normally selected, this being predetermined by the circumstance of use. Furthermore, a lower and an upper limit value for the torque must be set as minimum and maximum values $M_{min}$, $M_{max}$ which define the torque range in which, when a screw or the like is being tightened, the final value reached for the torque is to be correctly situated.

In the same way, minimum and maximum values $\beta_{min}$, $\beta_{max}$ are to be predetermined, in the angular range of which, beginning to count from the moment when the starting torque $M_s$ is reached, the deflection angle must be situated at the end of the measurement.

This desired-value presetting likewise includes the selection of the measurement itself. For example, by switching off one measuring device or the other, it is also possible to measure the torque M or measure the angular acceleration $\alpha$.

After the parameters have been set in step 17, the measurement of the torque M and the angular acceleration $\alpha$ is then begun, for example manually or under the control of one of the sensors, after the torque wrench has been applied. These measurements according to steps 18, 19 are carried out continuously over the entire tightening operation of, for example, a screw. In step 20, the torque measurement result is checked as to whether it is greater than or equal to the starting torque $M_s$. As long as the torque detected is less than this value, the torque measurement is continued in an entirely normal way.

The result of the acceleration measurement $\alpha$ is also checked regularly in step 21, specifically as to whether the direction of rotation coincides with the tightening direction of, for example, a nut. According to the presettings made here, the angular speed $\dot{\alpha}$ must then be greater than zero. This interrogation criterion must be seen, here, as an alternative, since, for example, the occurrence of a negative torque would likewise indicate that the direction of rotation has been reversed, for example during the use of a ratchet or lever brace. If there is such a return movement of the torque wrench 1, the measured acceleration value $\alpha$ is not processed any further and, in particular, is not added to the rotary angle $\alpha$ in the tightening direction. However, the acceleration measurement $\alpha$ is continued in an entirely normal way.

If it is detected, in step 21, that there is a pivoting movement of the torque wrench 1 in the tightening direction, that is to say, here, that the angular speed $\dot{\alpha}$ is greater than zero, double integration of the angular acceleration $\alpha$ over time is carried out. Various methods are available for this purpose. In analog integration, for example by means of differential amplifiers, continuous evaluation of the measurement values is carried out. An alternative possibility is, for example, to program a microprocessor which is present in the evaluation circuit 5 and which then uses individual measurement values as supporting values for numerical integration. In this case, too, various methods may once again be envisaged. Thus, the microprocessor may, for example, store all the measurement values as supporting values and calculate from these the rotary angle $\alpha$ at the current last measurement. Alternative methods make it possible for integration to take place only over the last time segment $\Delta t$, specifically from a preceding time segment $t-\Delta t$ to the time t, t signifying the current time and $\Delta t$ the timespan to the penultimate measurement. The result $\Delta\alpha$ of this integration is added to the preceding integration result. Such a numerical integration method is referred to, here, in the following description of the evaluation of the measurement values.

Figure 4:
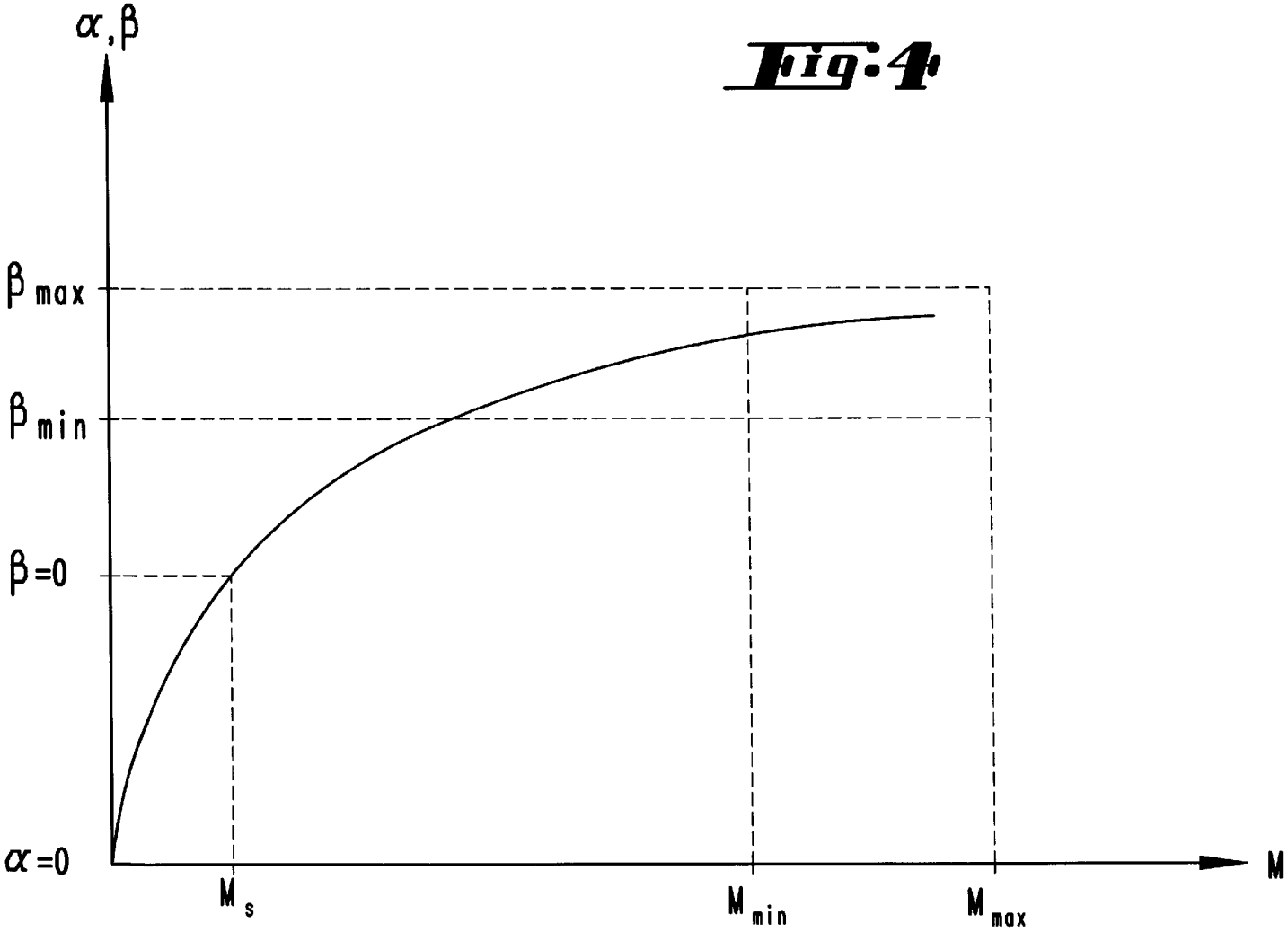
FIG. 4 shows the rotary angle or deflection angle plotted against the torque.

If the exceeding of the starting torque $M_s$ is detected in step 20, the determination of the deflection angle β begins, cf. also FIG. 4. Here too, alternative methods are available. Thus, as is preferred here, the current numerical value of α, that is to say the rotary angle covered up to this time, may be set to zero in step 23. Since the acceleration measurement is pursued continuously, it is, for example, possible to continue referring to stored intermediate values and continue to determine the deflection angle β from the acceleration measurement by integration. Alternatively, it would be possible to store the value of a present when the starting torque $M_s$ is exceeded and then to subtract the said value from the final value of the rotary-angle measurement, in order to determine the deflection angle β.

It will likewise become clear, at this juncture, that, in the embodiment described, acceleration measurement must begin at the same time as torque measurement. If the acceleration measurement α were to begin only when the starting torque $M_s$ was exceeded, the initial conditions for integration would then have to be additionally determined by measuring the angular speed $\dot{\alpha}$. Although this is fundamentally possible, it would mean a further sensor or further measurement or calculation for the torque wrench 1.

The aim of tightening a screw or the like by means of a torque wrench 1 according to the invention is to ensure that, ultimately, after the screw has been tightened, the torque lies between predetermined limit values $M_{min}$, $M_{max}$ and the deflection angle between limit values $\beta_{min}$, $\beta_{max}$. This is explained further with reference to the flow chart according to FIG. 3. After the starting torque $M_s$ has been exceeded, both the torque measurement 18 and the acceleration measurement 19 continue to be carried out without any change. The evaluation of the acceleration measurement α likewise continues to take place according to steps 21, 22, although, in the current memory, the rotary angle α is no longer summed up, but, according to step 23, summing the deflection angle β is now effected, as explained above.

In a step 30, there is then an interrogation as to whether the current values of the torque M and of the deflection angle β lie within the predetermined limit ranges according to FIG. 4. If this is not, at first, so because the values for the torque M and the deflection angle β are too low, in step 31 there is an interrogation as to whether the upper limit values $M_{max}$, $\beta_{max}$ have been exceeded by the current values. If the current values M, β still lie below the predetermined final range, this is obviously not the case and the torque measurement M and acceleration measurement α continue to be carried out without any change. Alternatively, step 31 may first be provided at a later time, specifically when the lower limit values $M_{min}$, $\beta_{min}$ have been exceeded. This step 31 would then follow step 30 in the "Yes" branch. As a result, where appropriate, computing capacity may also be saved.

When it is detected, in step 30, that a current measurement value M, β is within the specified interval of the lower and upper limit values, in step 32 signal triggering of, for example, the LED row 7 is carried out, to the effect that a measurement result is within the desired range. Depending on the linkage of the interrogations in step 30, such signal triggering may be carried out individually for each step or such signal triggering may also take place only when both criteria are satisfied. This last signal triggering indicates to the user that the tightening operation has ended successfully. A separate indication signals to the user that, at the end of the tightening operation, he must also ensure, with increased attentiveness, that the other criterion is reached. As before, however, the torque measurement M and the acceleration measurement α then also continue to be carried out.

If the correct end of the tightening operation is signalled by the signal triggering, the user will, as a rule, relieve the load on the torque wrench 1. The torque M, the angular acceleration α and the angular speed $\dot{\alpha}$ will therefore assume the value zero. If this is detected by the evaluation device 5 in step 33, it ensures that the final values are indicated, for example, on the LCD display 8. These final values may likewise be stored by the evaluation device 5, for example up to 1000 items. Alternatively, these final values may also be transmitted immediately or after storage to a computer 11 or printer 12, as explained in the introduction. If, however, in step 33, the evaluation device 5 detects that, as before, a torque M and/or an angular speed $\dot{\alpha}$ is present in the tightening direction, then, as before, the torque measurement M and acceleration measurement α are also carried out. Particularly in such a case where, for example, the user inattentively continues to tighten a screw, it may be detected, in step 30, that the current values M, β are no longer within the predetermined interval, but, instead, according to step 31, the predetermined upper limits $M_{max}$ and/or $\beta_{max}$ have been exceeded. In this case, signal triggering "faulty" occurs in step 35. Particularly in the case of faulty exceeding of the maximum limit values, it has also proved expedient to use an acoustic indicator, for example a buzzer.

In a way corresponding to step 33, it is detected, in a step 36, whether the tightening operation has ended, and there is then, correspondingly, a final-value indication 37 "faulty" or the measuring operation is pursued, as before.

What is claimed is:

1. Torque wrench comprising an electronic evaluation device for measurement values from sensors for detecting torque and a rotary angle, one sensor being an acceleration sensor (9) for detecting rotary-angle acceleration (α), wherein the evaluation device (5) integrates twice over time the measurement values from said sensor for determining the rotary angle (α), and wherein the evaluation device (5) is programmable with a starting torque ($M_s$) and determines a deflection angle (β) by a determination procedure initiated upon occurrence of a starting value of torque ($M_s$), and wherein the evaluation device having a preprogrammed range of torque, and further wherein a torque measured by the torque sensor is accepted by the evaluation device if within the preprogrammed range and rejected if outside the preprogrammed range.

2. Torque wrench according to claim 1, wherein the acceleration sensor (9) is disposed at a specific distance from an axis of rotation (2) in the torque wrench (1), and wherein the axis of rotation (2) serves for the acceleration sensor (9) as a virtual fixed point.

3. Torque wrench according to claim 1, wherein measurement values of the acceleration sensor (9) are evaluated only in a predeterminable direction of rotation.

4. Torque wrench comprising an electronic evaluation device for measurement values from sensors for detecting torque and a rotary angle, one sensor being an acceleration sensor (9) for detecting rotary-angle acceleration (α), wherein the evaluation device (5) integrates twice over time the measurement values from said sensor for determining the rotary angle (α), and wherein the evaluation device (5) is programable with a starting torque ($M_s$) and determines a deflection angle (β) when the starting torque ($M_s$) is reached; and wherein the evaluation device (5) is preprogramable in each case with a lower and an upper limit value of the torque ($M_{min}$, $M_{max}$) and a deflection angle ($\beta_{min}$, $\beta_{max}$) and the evaluation device indicates actual values (M, β) lying between the limit values.

5. Torque wrench according to claim 4, wherein the evaluation device (5) indicates an exceeding of the lower limit value of the torque ($M_{min}$) and of the deflection angle ($\beta_{min}$).

6. Torque wrench according to claim 4, wherein the evaluation device (5) indicates an exceeding of the upper limit value of the torque ($M_{max}$) and of the deflection angle ($\beta_{max}$).

7. Torque wrench according to claim 1, further comprising at least one light-emitting diode (7) for indication of values.

8. Torque wrench according to claim 1, further comprising analog means for evaluating the measurement values.

9. Torque wrench according to claim 1, wherein evaluation of the measurement values is carried out digitally.

10. Torque wrench according to claim 1, wherein measurement values of the acceleration sensor (9) are evaluated only in a direction of measurement of the angular speed ($\alpha$).

11. Torque wrench according to claim 4, wherein the evaluation device (5) indicates an exceeding of the lower limit value of the torque ($M_{min}$).

12. Torque wrench according to claim 4, wherein the evaluation device (5) indicates an exceeding of the lower limit value of the deflection angle ($\beta_{min}$).

13. Torque wrench according to claim 4, wherein the evaluation device (5) indicates an exceeding of the upper limit value of the torque ($M_{max}$).

14. Torque wrench according to claim 4, wherein the evaluation device (5) indicates an exceeding of the upper limit value of the deflection angle ($\beta_{max}$).

* * * * *